US006935082B2

(12) United States Patent
Hemstreet et al.

(10) Patent No.: US 6,935,082 B2
(45) Date of Patent: Aug. 30, 2005

(54) STORM IMPACT PROTECTION SYSTEM

(76) Inventors: Paul D. Hemstreet, 7089 Hemstreet Pl., West Palm Beach, FL (US) 33413; Gary M. Hemstreet, 7089 Hemstreet Pl., West Palm Beach, FL (US) 33413

( * ) Notice: Subject to any disclaimer, the term of this patent is extended or adjusted under 35 U.S.C. 154(b) by 137 days.

(21) Appl. No.: 10/025,104

(22) Filed: Dec. 19, 2001

(65) Prior Publication Data

US 2003/0110725 A1 Jun. 19, 2003

(51) Int. Cl.[7] ..... E06B 7/08

(52) U.S. Cl. ..... 52/473; 52/203; 52/506.05; 52/509; 49/62; 49/64; 160/215; 160/236

(58) Field of Search ..... 52/203, 506.05, 52/509, 202, DIG. 12; 49/61–64, 67, 50, 51; 160/215, 236

(56) References Cited

U.S. PATENT DOCUMENTS 1,240,634 A * 9/1917 Williams ..... 52/782.11
3,394,518 A * 7/1968 Worrell, Jr. ..... 52/473
3,797,186 A * 3/1974 Smith ..... 52/314
3,991,533 A * 11/1976 Nagase ..... 52/473
4,333,271 A * 6/1982 DePaolo et al. ..... 49/464
4,685,261 A * 8/1987 Seaquist ..... 52/202
4,733,515 A * 3/1988 Schmidlin ..... 52/473
5,345,716 A * 9/1994 Caplan ..... 49/61
5,383,315 A * 1/1995 Birs ..... 52/202
5,426,893 A * 6/1995 Hoffman ..... 49/464
5,457,921 A * 10/1995 Kostrzecha ..... 52/202
5,477,903 A * 12/1995 Figueiredo et al. ..... 160/183
5,487,244 A * 1/1996 Hill ..... 52/202
5,549,148 A * 8/1996 Figueiredo et al. ..... 160/183
5,566,739 A * 10/1996 Hoffman ..... 160/183
5,579,615 A * 12/1996 Hoffman ..... 52/202
5,737,874 A * 4/1998 Sipos ..... 49/67
5,957,186 A * 9/1999 Boswell ..... 160/201
5,996,292 A * 12/1999 Hill et al. ..... 52/202
6,189,264 B1 * 2/2001 DiVeroli ..... 49/57
6,209,263 B1 * 4/2001 Poirier ..... 49/61
6,345,476 B1 * 2/2002 Hill ..... 52/202
6,543,188 B1 * 4/2003 Poma et al. ..... 52/78
6,615,896 B1 * 9/2003 Andalia ..... 160/183

OTHER PUBLICATIONS

W.W. Schaefer Engineering & Consulting, P.A. Sketch of Storm Bar Connector, Dec. 8, 1999.

* cited by examiner

*Primary Examiner*—Carl D. Friedman
*Assistant Examiner*—Yvonne M. Horton
(74) *Attorney, Agent, or Firm*—Akerman Senterfitt

(57) ABSTRACT

A impact protection system for building openings, such as windows and doors, includes a shutter assembly having angled blades extending between frame members in such as manner that access areas are provided when the shutters are closed to permit insertion of a storm bar clip to secure a reinforcing storm bar. The storm bar can be secured to the surrounding wall by removable wall mounts.

22 Claims, 4 Drawing Sheets

STORM IMPACT PROTECTION SYSTEM

STATEMENT REGARDING FEDERALLY SPONSORED RESEARCH OR DEVELOPMENT (Not Applicable)

CROSS REFERENCE TO RELATED APPLICATIONS (Not Applicable)

FIELD OF THE INVENTION

This invention relates to window shutters, and more particularly to brace systems to secure window shutters during storms.

BACKGROUND OF THE INVENTION

The use of shutters for the protection of building openings, such as windows and doors, has been known for centuries. Colonial style shutters are arranged on either side of the opening and swing about hinges to close the opening during storms or other conditions requiring protection of the opening. A Bahamian style shutter mounts along the top of the opening and extends in an open position using prop bars extending between the wall and the lower portions of the shutter. During storms or other conditions requiring closure, the prop bars are moved to allow the Bahamian shutter to pivot downwardly and close the opening.

Over the years, it has been discovered that shutters made of wood are not sufficiently strong to resist high energy impact from high velocity projectiles such as wood beams, sign posts and the like launched during hurricanes and other strong storms. Accordingly, much development has occurred to create panels and other closures for openings during storm conditions.

Colonial and Bahamian style shutters can be constructed of sufficiently strong materials such as aluminum to withstand certain high energy impacts occurring during storm conditions. Typically, various storm closures such as storm panels and high strength shutters require various removable bolts, screws and other fasteners to secure the panels of shutters for impact protection.

These approaches typically result in the loss of the necessary fasteners and additional manpower and strength to prepare the closures for impact protection.

SUMMARY OF THE INVENTION

Accordingly, it is an object of the invention to provide colonial style, louvered shutters that can provide protection during storm conditions against impact with underlying windows, doors or other building openings.

It is a further object of the invention to provide colonial style, louvered shutters in a non-wood material to improve resistance against high force impact during storm conditions.

It is another object of the invention to provide colonial style louvered shutters with access areas for securing reinforcing bars without the need of bolts, screws or other removable fasteners.

It is a yet another object of the invention to provide an impact protection system for building openings that can be secured to wall structures surrounding the openings with removable mounts.

It is still another object of the invention to provide an impact protection system for building openings that includes removable mount systems that are esthetically pleasing when removed and do not require removable fasteners.

These and other objects of the invention are achieved by an impact protection system for openings of a building that includes at least one shutter constructed to provide access openings along its exposed face when the shutters are closed over the opening for storm or other related conditions. These access areas permit the insertion of bar clips for securing the shutters to a reinforcing storm bar extending across the shutters during storm conditions. The access areas can be provided by a specially arranged blade construction inserted into U-shaped openings along lateral frames of the shutter. The system can include one large shutter, conventional two shutter arrangements positioned on either side of an opening or even larger quantities of shutters such as three or four shutters, depending on the size of the opening to be covered.

The angled shutter blades used to provide the louvered appearance of the colonial style shutters are preferably provided with side flanges that extend at an angle to the blade but in parallel engagement with the sidewalls of the frame member openings. One of the side flanges can further include a connection flange extending away from the sidewall so as to engage the next adjacent blade. The connection flange and the next adjacent blade can be connected by a number of connector styles, including a sliding tongue and groove connector arrangement.

The reinforcing storm bar can be secured to the surrounding wall using known wall mounts, improved according to the invention. Prior wall mounts provide a receptacle for receiving the storm bar and securing it to the wall. It is known that the securement to the wall can occur either through bolting of the storm bar receptacle or matingly engaging the storm bar receptacle with a permanent mounting bracket on the wall.

According to an aspect of the invention, a preferred mating relationship between the storm bar receptacle and the wall bracket is a sliding tongue and groove arrangement in which the tongue forms a wide and secure base to the storm bar bracket.

The shutter blades used in the impact protection system can be constructed to assemble in series to create shutters of different lengths. The blades can interconnect by the connection flange. These blades can be provided individually, or in sets of three, extruded or molded together, for example.

Accordingly, the invention contemplates an impact protection system for building openings that can provide the esthetics of a colonial style louvered window while providing high energy impact protection in the closed position and a system for reinforcement with a storm bar without the use of reusable fasteners for securing the storm bar to the shutters.

The invention also is directed to a Bahamian style shutter which mounts along the top of a building opening. According to the invention, a series of closed hinges can be mounted along the top surface so as to avoid the appearance of the hinge and the diminishment of the aesthetics of the Bahamian shutter.

BRIEF DESCRIPTION OF THE DRAWINGS

Features and advantages of the present invention will become apparent to those skilled in the art from the following description with reference to the drawings, in which.

DETAILED DESCRIPTION OF PREFERRED EMBODIMENTS

The present invention relates to an impact protection system for building openings. More particularly, the present invention provides a brace system that secures and protects underlying windows, doors and building openings against impact during storm conditions. The invention provides colonial style louvered shutters in a non-wood material to improve resistance against high force impact during storm conditions. The invention also provides colonial style louvered shutters with access areas for securing reinforcing bars without the need to mount bolts, screws and other removable fasteners to the shutters. The invention further provides an impact protection system for building openings that can be secured to wall structures surrounding the openings with removable mounts.

Figure 1:
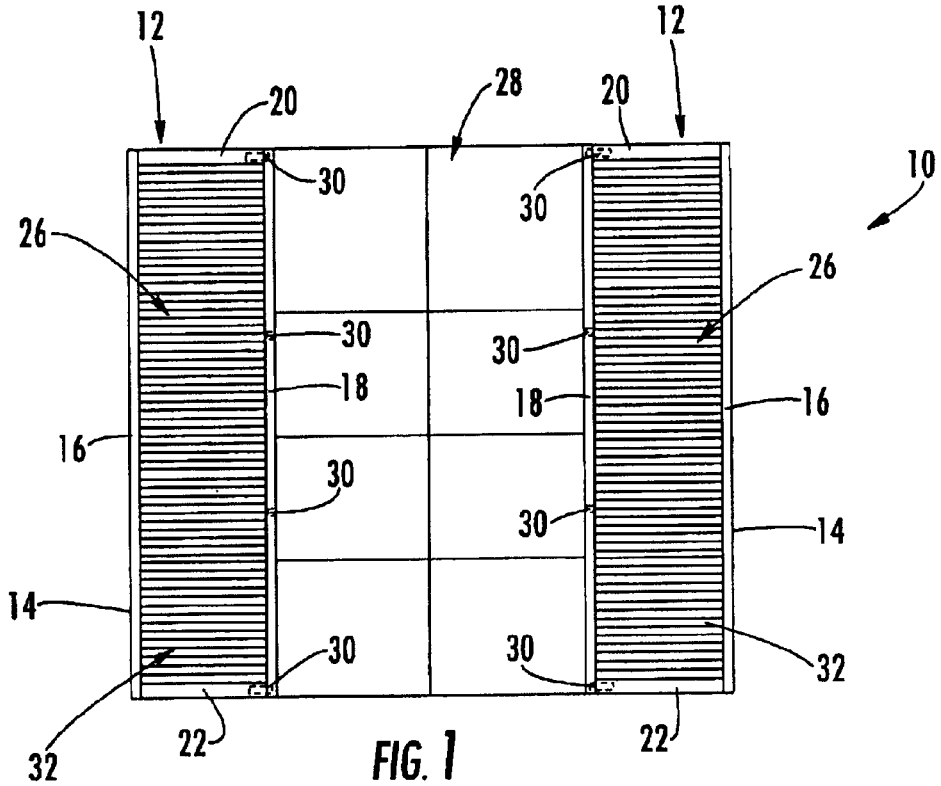
FIG. 1 is a front elevation view of a shutter system in accordance with the invention, in an open position.

FIG. 1 depicts an embodiment of the invention which provides protection to building openings during storm conditions. An impact protection system 10 for building openings can comprise at least one shutter 12, and depending on the size of the opening, two or more shutters. Each of the two shutters 12 illustrated has a shutter frame 14 including two opposing elongated lateral frame members 16, 18, bridged along the top and bottom by top and bottom frame members 20, 22.

Figure 4:
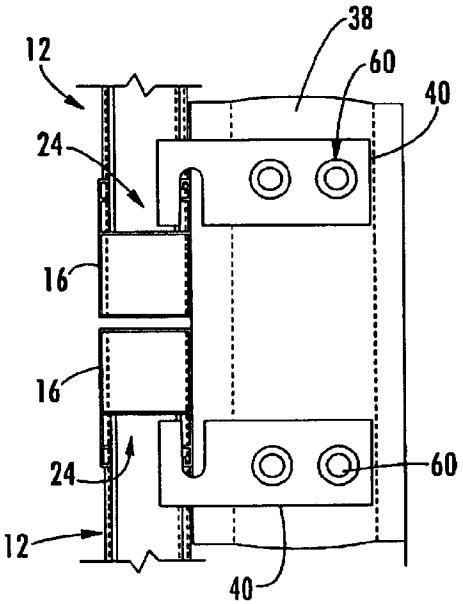
FIG. 4 is a sectional view from above of a breakaway of a shutter assembly secured by a storm bar and clip according the invention.

Referring briefly to FIG. 4, which is a top sectional view showing, among other things, the lateral frame members 16, it can be seen that each lateral frame member 16 provides an opening 24. This opening 24 can be generally U-shaped as shown. Referring back to FIGS. 1 and 2, the lateral frame members 16 provide the openings (not shown) facing toward the opposite lateral frame members 18.

Elongated shutter blades 26 extend between the two lateral frame members 16, 18 of each shutter 12. The shutter blades 26 have ends that are positioned in the facing openings 24 of the lateral frame members 16, 18 (See FIG. 3). The shutter blades 26 are angled relative to longitudinal axes of the lateral frame members 16, 18 and spaced along the lateral frame members 16, 18. Thus, the angled shutter blades 26 provide the louvered appearance of colonial style shutters.

Figure 2:
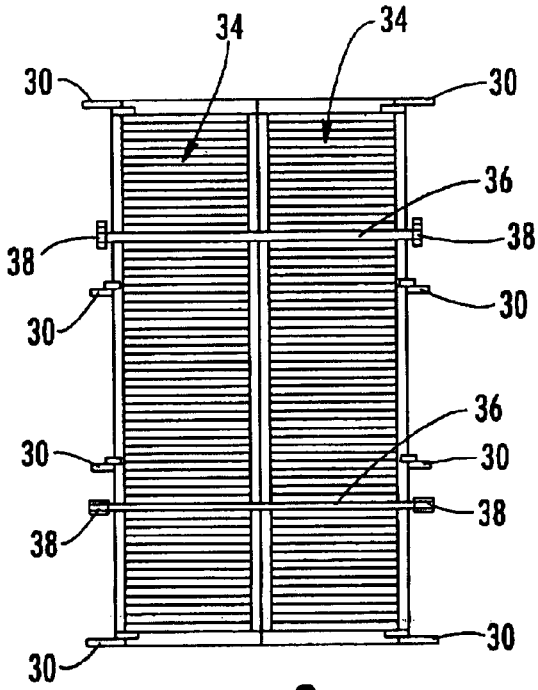
FIG. 2 is a front elevation view of a shutter system in accordance with the invention, in a closed position.

Each shutter 12 can be mounted around the window 28 using hinges 30. The hinges 30 permit each shutter 12 to pivot between open and closed positions. As illustrated in FIG. 1, while in the open position, a front face 32 of each shutter 12 can be exposed outwardly from the wall surrounding the window 28 while a rear face of the shutter 12 faces the wall. In a closed position, the front face of each shutter 12 faces the opening and the rear face 34 is exposed outwardly from the opening, as shown in FIG. 2.

The impact protection system can include one or more storm bars 36 for extending across the shutters 12 and mounting to the wall on opposite sides of the shutters 12. The storm bars 36 can be secured to the surrounding wall by mounting brackets 38 that are preferably removable so as not to interfere with the shutters 12 when the shutters 12 are swung to the open position as shown FIG. 1.

In prior systems, storm bars have been secured to shutters using bolts, screws or other removable fasteners. Such systems have suffered the disadvantages, not only of lost parts, but also the difficulty of assembly, particularly for elevated windows and under the time constraints created by an impeding storm.

Figure 3:
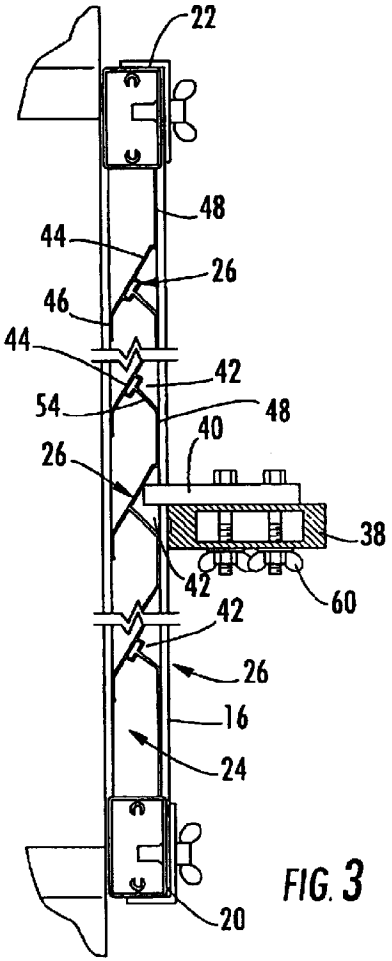
FIG. 3 is a side elevation view of a shutter blade assembly reinforced by a storm bar assembly in accordance with the principles of the invention.

Referring now to FIGS. 3 and 4, the invention provides a system that avoids mounting removable fasteners to shutters to secure storm bars. The storm bar 36 can instead be secured to the shutters 12 according to the invention using storm bar clips 40.

The storm bar clips 40 provide an insert portion for clipping onto the openings 24 of the lateral shutter frames 16. In order to provide the storm bar clips 40 access to these frame openings 24, the invention provides a shutter blade 26 that is arranged to provide a louvered appearance while providing openings 42 along its back surface for receiving the storm bar clips 40 and permitting lateral access to the frame openings 24.

The shutter blade construction includes a blade body 44 that is elongated and preferably planar. This blade body 44 is angled relative to vertical (which corresponds to the longitudinal axes of the lateral frame members) to provide the louvered appearance of the shutters. First and second side flanges 46, 48 extend from the blade body 44 at angles. The side flanges 46, 48 engage the lateral frame member 16 and position the blade body 44 in its angled, louvered arrangement.

Figure 5:
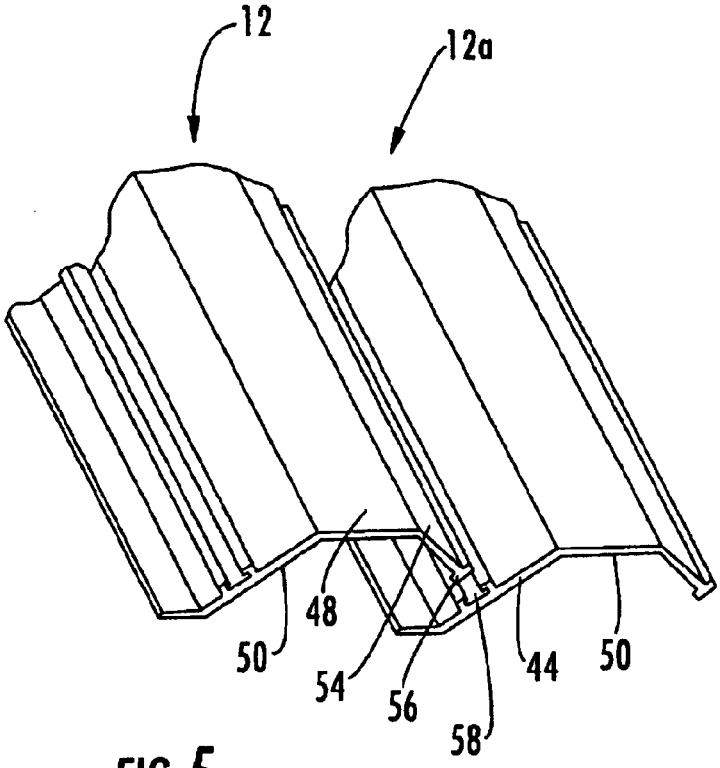
FIG. 5 is a partial perspective view of a pair of single connecting shutter blades according to the invention.
Figure 6:
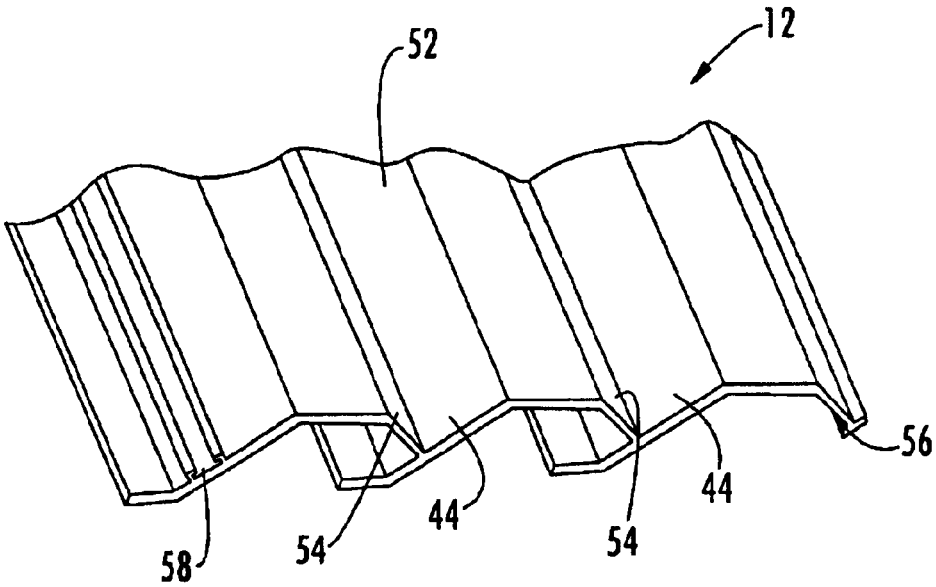
FIG. 6 is a partial perspective view of a three shutter blade permanent set according to the invention.

Referring to FIGS. 5 and 6, according to the invention, the shutter blades 26 can be made as single blades 50 or as permanent blade sets, for example, three blades 52, and joined together using connectors. By joining the blades, different height shutters can be customized to match particularly windows.

The blades are preferably connected together, either permanently or removably, by interaction of a connector flange 54 of a shutter blade 12 and the blade body 44 of the next adjacent blade 12*a*. The connector flange 54 preferably extends from one of the side flanges 48 at an angle and adjoins to the next adjacent blade body 44.

For connecting blades, the connector flange 54 and the adjacent blade body 44 can provide mating connecting structure, such as sliding tongue 56 and groove 58 connectors. Alternative connectors can also be used, for example, clips.

For multiple blade sets, the connecting flange 54 can be permanently affixed to the next adjacent blade body 44. For example, a set of three shutter blades can be molded or extruded together, so that the connecting flanges 54 and adjacent blade bodies 44 are unified.

The blade construction according to the invention provides not only the advantage of modularity, but also facilitates the mounting of the storm bar. It can be seen from FIG. 3 that the angular extension of the connecting flange 54 from the side flange 48 to the blade body 44 results in a depression 42 in the rear face of the shutter blade assembly. This depression or opening 42 runs the length of the blades 26 and extends into the lateral frame member openings 24. Accordingly, the storm clips 40 can insert into the rear blade depressions 42 and slide laterally into the frame openings 24 to secure the clip portion 40 to the frame members 16.

Once the storm bar clips 40 are positioned in the shutters 12, the clips 40 can be secured to the storm bar 36 with fasteners 60 such as bolts with wing nuts. FIG. 4 illustrates that once the clips 40 are mounted in oppositely facing openings 24 of adjacent shutters 12 and secured to the storm bar 36, lateral movement of the storm bar 36 is prevented. FIG. 4 is a partial view, showing the two innermost frame members 16 of a two shutter system. It should be understood that storm bar clips 40 can be used on the outermost lateral frame members 18 as well to further secure the storm bar 36 to the shutters 12.

Figure 7:
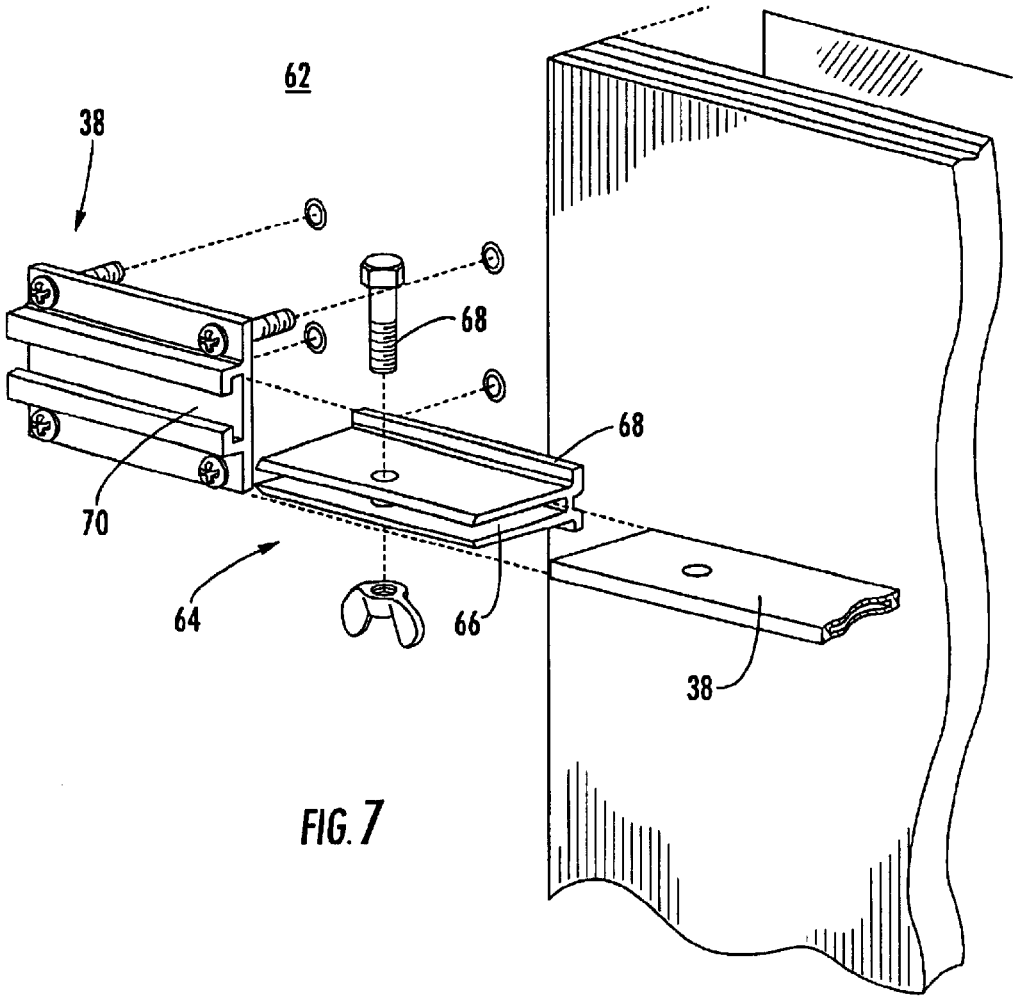
FIG. 7 is an exploded perspective view of a storm bar wall mounting system embodying aspects of the invention.

Referring to FIG. 7, the reinforcing storm bar 36, can be further secured to the surrounding wall 62 utilizing a wall mount 64. While a single wall mount 64 is shown, another wall mount is preferably provided on an opposite side of the building opening.

The wall mount 64 is preferably constructed to provide a receptacle 66 for receiving the storm bar 36 and securing it to the wall 62. The receptacle 66 of the wall mount 64 can be U-shaped. The wall mount 64 also can include a wall bracket 38 secured to the wall 62 and removably securing the U-shaped receptacle 66. The securement to the wall 62 can occur either Through bolting of the U-shaped receptacle 66 or matingly engaging the U-shaped receptacle 66 with a permanent mounting bracket 38 on the wall 62. The wall bracket 38 and the U-shaped receptacle 66 can be removably connected. A preferred connection of the wall bracket 38 and the U-shaped receptacle 66 is a tongue 68 and groove 70 relation. A tongue 68 and groove 70 connection further provides for the storm bar 36 to be easily secured by laterally sliding the U-shaped receptacle 66 into place and securing the receptacle 66 to the storm bar 36 by fasteners 68, such as bolts and fly nuts. The tongue base 68 forms the bottom of the receptacle 66 to provide a secure, direct engagement between the receptacle 66 and the bracket 38, avoiding any weakened regions of a spaced cantilevered positioning between the tongue and the storm bar receptacle.

The invention also is also directed to a Bahamian style shutter which mounts along the top of a building opening. According to the invention, a series of closed hinges can be mounted along the top surface so as to avoid the appearance of the hinge and the diminishment of the aesthetics of the Bahamian shutter.

It will of course be understood that the invention is not limited to the specific details described herein, which are given by way of example only, and that various modifications and alterations are possible within the scope of the invention as defined in the appended claims. For example, the shutter blades to be used in the impact protection system can be constructed to assemble in series to create shutters of different lengths. Additionally, the system can include a varying number of shutters. One embodiment may include one large shutter, a conventional two shutter arrangement positioned on either side of an opening, or larger quantities depending on the opening to be covered.

What is claimed is:

1. An impact protection system for building openings, the system comprising:

a shutter having a shutter frame including two opposing elongated lateral frame members having facing openings;

shutter blades extending between the two lateral frame members along blade axes and having ends positioned in the facing openings;

the shutter blades being angled relative to longitudinal axes of the frame members and spaced along the longitudinal axes of the frame members;

the blades each having transverse edges extending along the blade axis, a side flange extending, at a first end, from one of said transverse edges of the blade and extending substantially parallel to the longitudinal axes of the frame members;

a connecting flange extending from an end of the side flange opposite said first end, said connecting flange connecting to an adjacent blade at a location between its transverse edges and spaced from said transverse edges;

whereby the shutter blades provide a louvered appearance on one side and provide access to the facing openings between at least two of the shutter blades on the opposing side for insertion of bracing clips when the shutter is arranged for impact protection; and a hinge provided along one of the lateral frame members for mounting the shutter to a wall adjacent an opening to be protected, the hinge permitting the shutter to pivot between an open position against the wall, in which a front face of the shutter is exposed outwardly from the wall and a rear face of the shutter faces the wall, and a closed position over the opening, in which the front face faces the opening and the rear face is exposed outwardly from the opening;

in the closed position, said facing openings including access areas adjacent the shutter blades on the exposed rear face of the shutter.

2. The system of claim 1, wherein there are at least two of the shutters.

3. The system of claim 1, wherein the openings of the lateral frame members are each defined by a U-shaped cross section of the elongated frame member having two side walls and a terminal wall, the side flanges engaging the side walls and the blades being angled relative to the flanges and the side walls.

4. A shutter for an impact protection system for building openings, comprising:

a shutter frame including two opposing elongated lateral frame members having facing openings;

shutter blades extending between the two lateral frame members along blade axes and having ends positioned in the facing openings; and the shutter blades being angled along the blade axes relative to the longitudinal axes of the frame members and spaced along the frame members;

the blades each having transverse edges extending along the blade axis, a side flange extending, at a first end, from one of said transverse edges of the blade and extending substantially parallel to the longitudinal axes of the frame members;

a connecting flange extending from an end of the side flange opposite said first end, said connecting flange connecting to an adjacent blade at a location between its transverse edges and spaced from said transverse edges;

whereby the shutter blades provide a louvered appearance on one side and provide access to the facing openings between at least two of the shutter blades on the opposing side for insertion of bracing clips when the shutter is arranged for impact protection.

5. The shutter of claim 4, wherein the openings of the lateral frame members are each defined by a U-shaped cross section of the elongated frame member having two side walls and a terminal wall, the flanges engaging the side walls and the blades being angled relative to the flanges and the side walls.

6. The shutter of claim 5, wherein the connection flange and the adjacent blade are removably connected.

7. The shutter of claim 6, wherein the connecting flange and the adjacent blade are joined by a tongue and groove connection.

8. The shutter of claim 7, wherein the connecting flange is formed with the adjacent blade over a series of blades.

9. A shutter blade assembly, comprising:

a first shutter blade and an adjacent shutter blade, each having:

an elongated blade body having transverse edges parallel to the longitudinal axis of the blade body;

at least one side flange extending at an angle from said blade body along one of said transverse edges, said side flange being adapted to engage a shutter frame and position said blade body at an angle relative to the shutter frame;

a connecting flange extending at an angle from the side flange along its length on a side opposite the blade body;

said connecting flange of the first shutter blade being adapted to connect to the blade body of the adjacent shutter blade at a location between its transverse edges and spaced from said transverse edges.

10. The shutter blade assembly of claim 9, wherein the connecting flange of the first shutter blade is permanently connected to the blade body of the adjacent shutter blade.

11. The shutter blade assembly of claim 9, further comprising a third shutter blade having an elongated blade body; said blade body have an angled side flange extending therefrom and a connecting flange extending from the side flange;

wherein the connecting flange of the adjacent blade is permanently connected to the blade body of the third blade, whereby a triple shutter blade assembly is provided and having a connecting flange available for connection to further shutter blades.

12. The shutter blade assembly of claim 9, wherein the connecting flange of the first shutter blade is permanently affixed at its end to the blade body of the adjacent shutter blade.

13. The shutter blade assembly of claim 9, wherein the connecting flange of the first shutter blade is removably connected to the blade body of the adjacent shutter blade.

14. The shutter blade assembly of claim 13, wherein the connecting flange of the first shutter blade has a tongue connector and the adjacent shutter blade body has a mating groove for receiving the tongue connector.

15. The shutter blade assembly of claim 9, wherein each blade further comprises a second side flange extending from a longitudinal edge of the blade body opposite said connecting flange, said side flanges being generally planar and parallel.

16. An impact protection system for building openings, the system comprising:

a shutter having a shutter frame including two-opposing elongated lateral frame members having facing openings;

shutter blades extending between the two lateral frame members along blade axes and having ends positioned in the facing openings;

the shutter blades being angled relative to longitudinal axes of the frame members and spaced along the longitudinal axes of the frame members;

whereby the shutter blades provide a louvered appearance on one side and provide access to the facing openings between at least two of the shutter blades on the opposing side for insertion of bracing clips when the shutter is arranged for impact protection;

a hinge provided along one of the lateral frame members for mounting the shutter to a wall adjacent an opening to be protected, the hinge permitting the shutter to pivot between an open position against the wall, in which a front face of the shutter is exposed outwardly from the wall and a rear face of the shutter faces the wall, and a closed position over the opening, in which the front face faces the opening and the rear face is exposed outwardly from the opening;

in the closed position, said facing openings including access areas adjacent the shutter blades on the exposed rear face of the shutter;

a storm bar for extending across the shutter and mounting to the wall on opposite sides of the opening;

a storm bar clip secured to the storm bar and having a shutter insert for insertion into the access area to secure the storm bar to the shutter; and a wall mount for securing the storm bar to the wall on opposite sides of the opening, whereby the storm bar is secured to the shutter without the use of bolts or other removable fasteners.

17. The system of claim 16, further comprising a connection flange for connecting with an adjacent blade.

18. The system of claim 17, wherein the connection flange extends from an end flange of a first blade for connection to an adjacent blade.

19. The system of claim 17, wherein the connection flange and the adjacent blade are removably connected.

20. The system of claim 19, wherein the connection flange and the adjacent blade are joined by a tongue and groove connection.

21. The system of claim 17, wherein the connection flange is formed with the adjacent blade over a series of blades.

22. The system of claim 16, wherein the wall mount includes a U-shaped receptacle for removably receiving the storm bar and a wall bracket to be secured to the wall and removably securing the U-shaped receptacle, said wall bracket providing a groove, said U-shaped receptacle providing a base that removably slides into said groove of said wall bracket, said U-shaped receptacle base being wider than a width of said storm bar, said U-shaped receptacle being formed by the extension of two from said base, whereby the base provides a portion of the U and provides a wide and secure base for holding the storm bar to the wall.

* * * * *